US008806758B2

(12) United States Patent
Pineda

(10) Patent No.: US 8,806,758 B2
(45) Date of Patent: Aug. 19, 2014

(54) STRAIGHT EDGE RAZOR WITH ALTERNATE BLADE POSITIONS

(76) Inventor: Eliath Antonio Pineda, New York, NY (US)

( * ) Notice: Subject to any disclaimer, the term of this patent is extended or adjusted under 35 U.S.C. 154(b) by 182 days.

(21) Appl. No.: 13/523,873

(22) Filed: Jun. 14, 2012

(65) Prior Publication Data

US 2013/0333221 A1 Dec. 19, 2013

(51) Int. Cl.
*B26B 21/10* (2006.01)

(52) U.S. Cl.
USPC ..... 30/53; 30/30

(58) Field of Classification Search
CPC ..... B26B 21/08; B26B 21/10; B26B 21/12; B26B 21/125
USPC ..... 30/47, 51, 53, 54, 55
See application file for complete search history.

(56) References Cited

U.S. PATENT DOCUMENTS

| | | | | | |
|---|---|---|---|---|---|
| 1,336,969 | A * | 4/1920 | La Rock | 30/53 |
| 1,461,490 | A * | 7/1923 | McNaulty | 30/55 |
| 1,932,458 | A * | 10/1933 | Hanson | 30/55 |
| 3,323,208 | A * | 6/1967 | Hurley, Jr. | 606/120 |
| 3,402,467 | A * | 9/1968 | Manahan | 30/30 |
| 3,728,788 | A * | 4/1973 | Pearson | 30/53 |
| 4,319,399 | A * | 3/1982 | Ciaffone | 30/32 |
| 4,536,102 | A * | 8/1985 | Doyle | 403/390 |
| 4,665,615 | A * | 5/1987 | Martinez | 30/53 |
| 4,920,644 | A * | 5/1990 | LaGattuta | 30/53 |
| 5,611,146 | A * | 3/1997 | Ducret | 30/92 |
| 6,094,820 | A * | 8/2000 | Adachi | 30/30 |
| 6,477,777 | B1 * | 11/2002 | Oliveri | 30/161 |
| 6,722,039 | B2 * | 4/2004 | Kitano | 30/50 |
| 6,877,229 | B2 * | 4/2005 | Sakai | 30/146 |
| 2005/0221691 | A1 * | 10/2005 | Li | 439/886 |

FOREIGN PATENT DOCUMENTS

| | | | |
|---|---|---|---|
| DE | 19 66 990 | * | 3/1976 |
| GB | 1 486 124 | * | 9/1977 |

* cited by examiner

*Primary Examiner* — Hwei C Payer
(74) *Attorney, Agent, or Firm* — Lyman Smith

(57) ABSTRACT

A straight edge razor enables the operator to move the blade between two different settings—a first setting that hides the two sharp corners of the blade, and a second setting that exposes the two sharp corners. The first setting can make shaving a client or oneself an easy task. In the second setting, the razor can be used as a tool for easily sharpening up lines on a haircut. The razor of the present invention also allows the operator to take the device apart for cleaning and replacing a damaged part.

9 Claims, 3 Drawing Sheets

STRAIGHT EDGE RAZOR WITH ALTERNATE BLADE POSITIONS

BACKGROUND OF THE INVENTION

The present invention relates to razors and, more particularly, to a straight edge razor with alternate blade positions.

Conventional straight edge razors on the market hold the blade in one position. These conventional straight edge razors can be intimidating to new users (barbers, stylists, or the like). The users that are brave enough to use one often end up cutting a lot of customers before they master the razor.

Moreover, with conventional straight edge razors, there is no way to take it apart should part of the razor require repair. If a certain part of the razor fails, the user is forced to toss it away and buy a new straight edge razor.

Also, conventional straight edge razors may be difficult to clean. Since the user cannot take apart the conventional razors, the user may need to rely on cleaners soaking into difficult to clean areas of the razor.

As can be seen, there is a need for an improved straight edge razor that can provide different blade settings and can easily come apart for cleaning or repair.

SUMMARY OF THE INVENTION

In one aspect of the present invention, a straight edge razor comprises an upper shank and a lower shank adapted to hold a razor blade therebetween; a handle having a first end of the upper shank and the lower shank pivotably attached thereto; a clamp operable to fit around an edge of the upper shank and the lower shank to secure the upper shank and lower shank together; etched grooves disposed on an inside surface of at least one of the upper shank and the lower shank; and a spacer/stopper disposed to provide a gap between the handle to dispose the upper and lower shanks therein.

In another aspect of the present invention, a straight edge razor having alternate razor blade positions comprises an upper shank and a lower shank adapted to hold a razor blade therebetween; a handle having a first end of the upper shank and the lower shank pivotably attached thereto; a clamp operable to fit around an edge of the upper shank and the lower shank to secure the upper shank and lower shank together; a pin to pivotably attach the clamp to one of the upper shank and the lower shank; locator posts extending from the inside surface of at least one of the upper shank and the lower shank, the locator posts providing support for the razor blade in a first position where corners of a cutting edge of the razor blade are hidden between the upper shank and the lower shank; etched grooves disposed on an inside surface of at least one of the upper shank and the lower shank, the etched grooves disposed in a position to support the razor blade in a lower position, where a cutting edge of the razor blade is exposed when the blade is secured between the upper shank and the lower shank; and a spacer/stopper disposed to provide a gap between the handle to dispose the upper and lower shanks therein.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a straight edge razor that enables the operator to move the blade between two different settings—a first setting that hides the two sharp corners of the blade, and a second setting that exposes the two sharp corners. The first setting can make shaving a client or oneself an easy task. In the second setting, the razor can be used as a tool for easily sharpening up lines on a haircut. The razor of the present invention also allows the operator to take the device apart for cleaning and replacing a damaged part.

Figure 1:
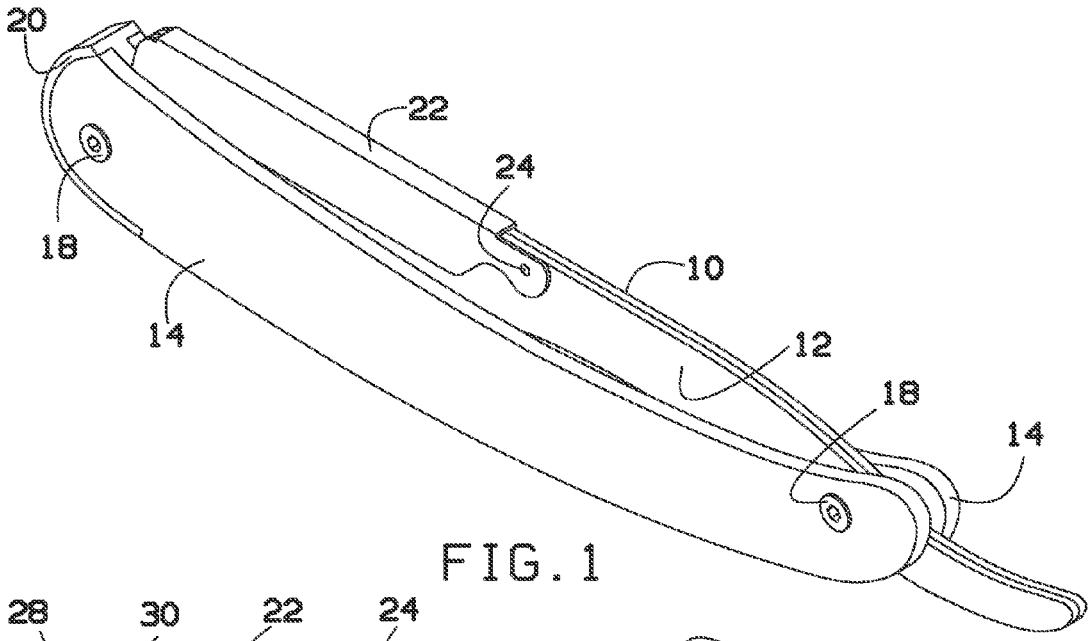
FIG. 1 is a perspective view of a straight edge razor, in a closed position, according to an exemplary embodiment of the present invention.
Figure 2:
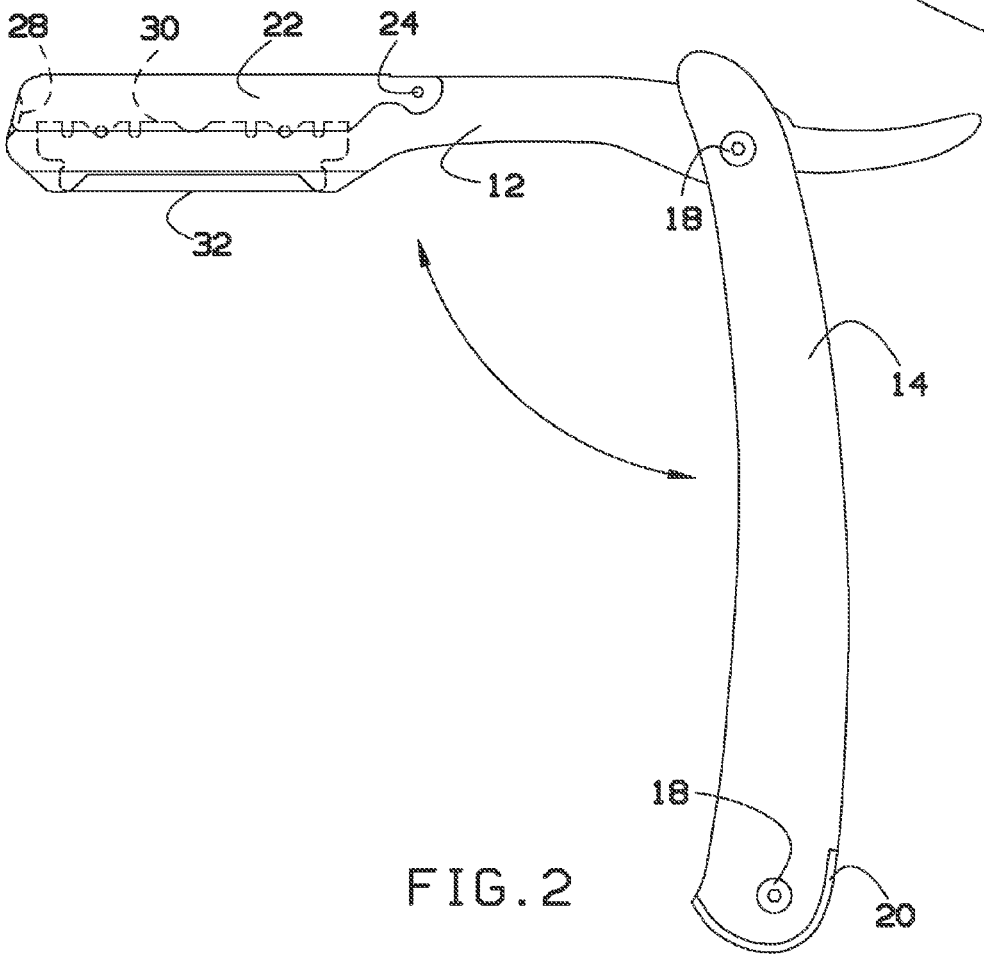
FIG. 2 is a side view of the straight edge razor of FIG. 1, in a partially opened position.
Figure 3:
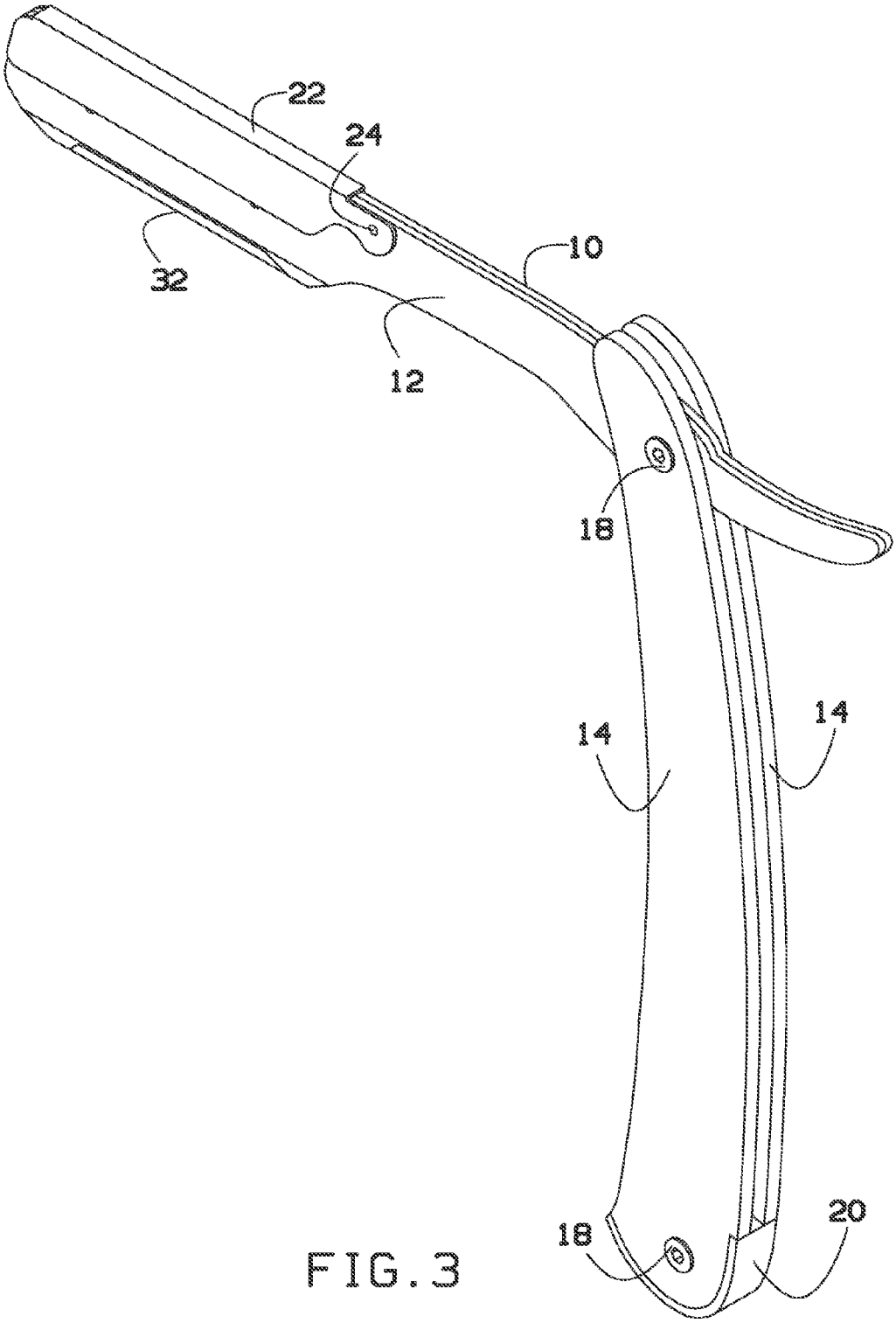
FIG. 3 is a perspective view of the straight edge razor of FIG. 1, in a partially opened position, with the blade being in a first position.
Figure 4:
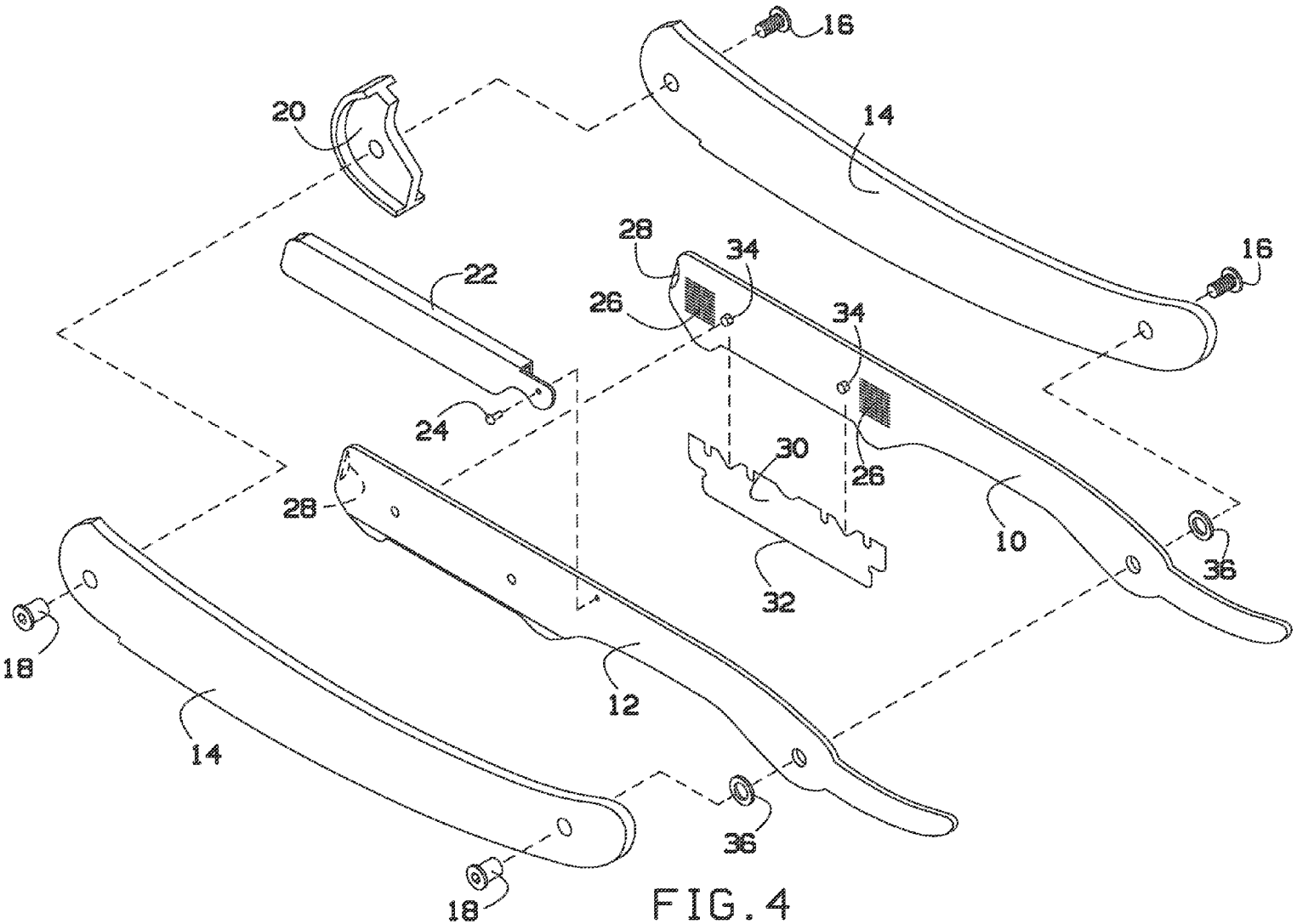
FIG. 4 is an exploded perspective view of the straight edge razor of FIG. 1.

Referring to FIGS. 1 through 4, a razor includes an upper shank 10 and a lower shank 12. A first end of the upper and lower shanks 10, 12 is pivotably attached to and sandwiched between handles 14 on a first end of the handles 14. A screw 16 and screw post 18 may pass through handles 14 and the shanks 10, 12. A bearing member 36 may be disposed between each of the shanks 10, 12 and the handles 14. The bearing member 36 may be, for example, a plastic bearing to help the shanks 10, 12 to pivot relative to the handles 14.

A spacer/stopper 20 may be disposed on a second, opposite end of the handles 14 and another screw 16 and screw post 18 may be used to secure the handles 14 together with the spacer/stopper 20 disposed therebetween.

The upper shank 10 may include blade locator posts 34 extending from a side of the upper shank 10. The posts 34 may be disposed to hold a blade 30 in the first position, where the corners of the blade cutting edge 32 are not exposed. The posts 34 may fit into holes formed in the lower shank 12.

A clamp 22 may be fastened to one of the shanks 10, 12 with a pin 24 so that the clamp 22 can pivot over an upper side of the shanks 10, 12, and bind them together, securing the razor blade 30 therebetween.

At least one of the shanks 10, 12 can include etched grooves 26 disposed on its inner face. The etched grooves 26 can be, for example, about ¼ inch etched grooves 26, parallel to both snapped edges of the razor blade 30. The etched grooves 26 can facilitate lateral adjustability of the blade 30 relative to the lower edge of the shanks 10, 12 from which blade cutting edge 32 protrudes. A user can position the blade 30 in the second position, where the corners of the cutting edge 32 are exposed, and the etched grooves 26 can keep the blade 30 held in this position.

A fingernail edge pull 28 can be cut in a distal end (relative to the pivoting handle connection end) of the shanks 10, 12 to facilitate a user with opening the razor for use.

To use the razor of the present invention, a user can open the clamp 22, use the fingernail edge pull 28 to open the shanks 10, 12 from the handle 14, and place the blade 30 against the two posts 34. The user can then move the clamp 22 over the shanks 10, 12 to fix the blade 30 in this position, where the corners of the cutting edge 32 are hidden in the contours of the shanks 10, 12. If the user chooses to expose the corners of the cutting edge 32, the user can place the blade on top of the etched grooves 26 (typically there may be two etched groove sets 26—one etched groove set 26 cut to secure each end of the blade 30) and close the clamp 22. The etched grooves 26 will hold the blade in position (the second position) with the corners of the cutting edge 32 of the blade 30 exposed. In some embodiments, a user can spray water on the etched grooves 26. The water can act like an adhesive to help secure the blade 30 between the upper and lower shanks 10, 12.

The various components of the present invention can be made of various suitable materials. For example, the handle 14 can be made in a variety of colors and materials, such as plastic, acrylic, hardwood, metal or the like. Similarly the clamp 22 and the shanks 10, 12 can be made of various materials, however, for these components, stainless steel is typically used. The screws 16 may be formed in various styles and designs. Typically, the screws 16 can be hex head, Allen-type of screws that can be easily removed for disassembly of the razor for cleaning or repair.

It should be understood, of course, that the foregoing relates to exemplary embodiments of the invention and that modifications may be made without departing from the spirit and scope of the invention as set forth in the following claims.

What is claimed is:

1. A straight edge razor comprising:

an upper shank and a lower shank adapted to hold a razor blade therebetween;

a handle having a first end of the upper shank and the lower shank pivotably attached thereto;

a clamp operable to fit around an edge of the upper shank and the lower shank to secure the upper shank and the lower shank together;

locator posts extending from an inside surface of at least one of the upper shank and the lower shank, the locator posts providing support for the razor blade in a first position where corners of a cutting edge of the razor blade are hidden between the upper shank and the lower shank;

etched grooves disposed on an inside surface of at least one of the upper shank and the lower shank; and a spacer/stopper disposed to provide a gap between the handle and the upper and lower shanks.

2. The straight edge razor of claim 1, further comprising a screw and a screw post for pivotably securing the upper and lower shanks to the handle.

3. The straight edge razor of claim 2, further comprising a bearing disposed on the screw between each of the upper and lower shanks and the handle.

4. The straight edge razor of claim 1, wherein the etched grooves disposed in a position to support the razor blade in a lower position, where corners of the cutting edge of the razor blade are exposed when the blade is secured between the upper shank and the lower shank.

5. The straight edge razor of claim 1, further comprising a pin to pivotably attach the clamp to one of the upper shank and the lower shank.

6. The straight edge razor of claim 1, further comprising a fingernail edge pull disposed along an edge of the upper and lower shanks, the fingernail edge pull operable to permit a user to open the upper and lower shanks from the handle.

7. A straight edge razor having alternate razor blade positions, comprising:

an upper shank and a lower shank adapted to hold a razor blade therebetween;

a handle having a first end of the upper shank and the lower shank pivotably attached thereto;

a clamp operable to fit around an edge of the upper shank and the lower shank to secure the upper shank and the lower shank together;

a pin to pivotably attach the clamp to one of the upper shank and the lower shank;

locator posts extending from an inside surface of at least one of the upper shank and the lower shank, the locator posts providing support for the razor blade in a first position where corners of a cutting edge of the razor blade are hidden between the upper shank and the lower shank;

etched grooves disposed on the inside surface of at least one of the upper shank and the lower shank, the etched grooves disposed in a position to support the razor blade in a lower position, where corners of the cutting edge of the razor blade are exposed when the blade is secured between the upper shank and the lower shank; and a spacer/stopper disposed to provide a gap between the handle and the upper and lower shanks.

8. The straight edge razor of claim 7, further comprising:

a screw and a screw post for pivotably securing the upper and lower shanks to the handle; and a bearing disposed on the screw between each of the upper and lower shanks and the handle.

9. The straight edge razor of claim 7, further comprising a fingernail edge pull disposed along an edge of the upper and lower shanks, the fingernail edge pull operable to permit a user to open the upper and lower shanks from the handle.

* * * * *